US005842292A

United States Patent [19]

Siesel

[11] Patent Number: 5,842,292

[45] Date of Patent: Dec. 1, 1998

[54] SHOE INSERT

[75] Inventor: Kathy J. Siesel, 10301 Lake Ave., #513, Cleveland, Ohio 44102-1276

[73] Assignee: Kathy J. Siesel, Ohio

[21] Appl. No.: 818,968

[22] Filed: Mar. 14, 1997

[51] Int. Cl.[6] ..... A43B 23/28

[52] U.S. Cl. ..... 36/58.5; 36/58.6; 36/71

[58] Field of Search ..... 36/71, 93, 58.5, 36/58.6

[56] References Cited

U.S. PATENT DOCUMENTS

| | | | |
|---|---|---|---|
| D. 354,616 | 1/1995 | Schroer, Jr. . | |
| D. 367,164 | 2/1996 | Fisher et al. . | |
| 460,600 | 10/1891 | Sargent | 36/58.5 |
| 1,155,209 | 9/1915 | Burke | 36/58.5 |
| 1,408,721 | 3/1922 | Carrel . | |
| 1,710,077 | 4/1929 | Scholl | 36/58.5 |
| 1,712,420 | 5/1929 | Carlson | 36/58.5 |
| 1,812,622 | 6/1931 | Costello | 36/58.5 |
| 1,926,818 | 9/1933 | Ratcliff | 36/58.5 |
| 1,966,179 | 7/1934 | Lesch | 36/58.5 |
| 2,275,191 | 3/1942 | Schwartz et al. | 36/58.5 |
| 2,489,429 | 11/1949 | Nathan | 36/58.5 |
| 3,015,896 | 11/1962 | Breslow . | |
| 3,050,878 | 8/1962 | Goeckner et al. . | |
| 3,780,454 | 12/1973 | Godwin . | |
| 4,503,628 | 3/1985 | Mancinelli et al. . | |
| 4,642,916 | 2/1987 | Collins . | |
| 5,282,326 | 2/1994 | Schroer, Jr. et al. . | |
| 5,539,020 | 7/1996 | Bracken et al. . | |

FOREIGN PATENT DOCUMENTS

| | | | |
|---|---|---|---|
| 2226 | 5/1931 | Australia | 36/58.5 |
| 212394 | 1/1940 | Germany | 36/58.5 |
| 299249 | 2/1929 | United Kingdom | 36/58.5 |
| 364732 | 11/1930 | United Kingdom | 36/58.5 |

*Primary Examiner*—M. D. Patterson
*Attorney, Agent, or Firm*—Watts, Hoffmann, Fisher & Heinke,L.P.A.

[57] ABSTRACT

A shoe insert for adjusting the fit of a shoe on a person's foot. The insert is formed from resilient material and is secured within the heel area of a shoe. The insert is elongated and has a narrow central portion for engaging a person's heel between the heel bone and the achilles tendon, and a pair of enlarged lateral portions for engaging the sides of the heel. The insert also has a tapered thickness which decreases from a thick upper part toward a thin lower part of the insert.

17 Claims, 2 Drawing Sheets

SHOE INSERT

BACKGROUND OF THE INVENTION

1. Field of the Invention

The present invention relates to devices for adjusting or improving the fit of a shoe on a person's foot. More particularly, the invention relates to an insert that prevents a shoe from slipping off the heel of a person's foot.

2. Description of Related Art

For many people it is difficult or impossible to purchase shoes that fit in a proper or comfortable manner. Despite selecting shoes that are the correct size, i.e., the best fitting size available for a given shoe style, people still are often forced to wear shoes that fit poorly. For example, the shoes may fit well in one area of a person's foot, but be too small or large in another area. This is often the case even though shoe manufacturers typically offer different widths for a particular shoe size.

One problem with shoes that do not fit properly is their tendency to slip off a person's feet. For example, the back portion of a shoe sometimes slips off a person's heel during walking. This problem is especially prevalent with respect to women's shoes. Although women's feet generally seem to have a different width combination or configuration than men's feet, shoe manufacturers typically produce women's shoes by using lasts, or forms, that are shaped the same as lasts used to produce mens shoes.

A particular problem in the art is that women's shoes, and specifically women's dress shoes, fit well in one but not both of the heel and forefoot areas. For example, if the heel of the shoe fits, the forefoot is usually too narrow so that wearing the shoe is painful. Conversely, if the forefoot of the shoe fits, the heel is usually too wide so that the shoe does not stay on the foot. As a result, women's shoes often do not fit correctly, and thus many women purchase various types of devices to improve the fit of their shoes.

Those in the art have proposed various devices to improve the fit of shoes on a person's foot. Several commercially available devices are intended to prevent slipping and rubbing at the heel and are configured to be secured within the heel of a shoe. One known device is in the form of a foam rubber sheet with slightly curved upper and lower edges joined by rounded side edges, the sheet having adhesive on the rear surface for attachment to a shoe. The peripheral edges of such devices are bevelled or tapered somewhat with respect to the heel-engaging area. The performance of these heel inserts has not been fully satisfactory to all purchasers. For example, the inserts often push the foot forward in the shoe which is uncomfortable. Consequently, many women choose to purchase shoes that fit in the heel and thus stay on, but do not fit well otherwise.

SUMMARY OF THE INVENTION

The invention provides an insert for a shoe that aids in fitting the shoe to a person's foot. The insert preferably is constructed as a separate element from a shoe and is provided with means for being secured within the interior of a shoe. Alternatively, the insert may be a member incorporated within the shoe during manufacturing of the shoe.

In a preferred embodiment, the insert is configured to be placed within and conform to the interior of the heel area of a shoe. The insert is formed at least in part of a generally resilient material and has a thickness, width and length, the length being greater than the width to provide the insert with a generally elongated shape. The insert has upper and lower longitudinal edges and a pair of lateral edges extending between the longitudinal edges. The longitudinal and lateral edges preferably are joined at rounded corners to provide the insert with a smooth continuous perimeter.

In one aspect of the invention, the insert has a narrow central section for resting just above the back of a person's heel bone, and two enlarged lateral sections disposed on opposite sides of the central section for contacting the sides of the heel bone. The central and lateral sections of the insert have a maximum width defined between the upper and lower longitudinal edges. The maximum width of the narrow central section is preferably less than about one-half, and most preferably about one-third, the maximum width of either enlarged lateral section. This construction ensures that the center of the insert rests above the heel bone rather than being sandwiched between the heel bone and shoe, which tends to force the foot forward.

In another aspect of the invention, the thickness of the insert is tapered along its width to define a thick area located adjacent an upper end of the insert and a thin area located adjacent a lower end of the insert.

DETAILED DESCRIPTION OF PREFERRED EMBODIMENTS

Figure 1:
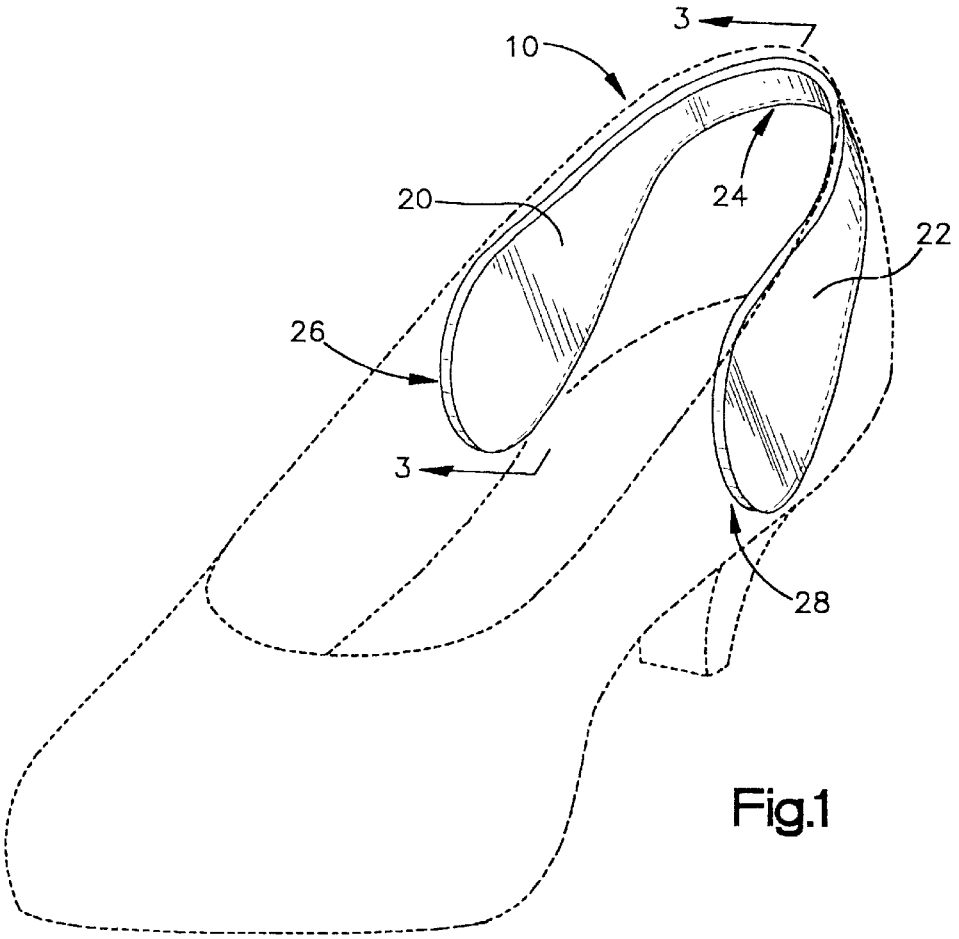
FIG. 1 is a perspective view of a shoe insert constructed according to a preferred embodiment of the invention, the insert positioned within a shoe shown in phantom.

With reference to FIG. 1, a shoe insert constructed according to a preferred embodiment of the invention is indicated generally by the reference numeral 10 and is shown positioned in a shoe (depicted in phantom). The insert is positioned within the heel area of a shoe to contact a person's heel. The term "insert" is used herein to describe a member constructed to be secured to an already manufactured shoe, or a member that is incorporated into a shoe during manufacturing of the shoe.

Figure 2:
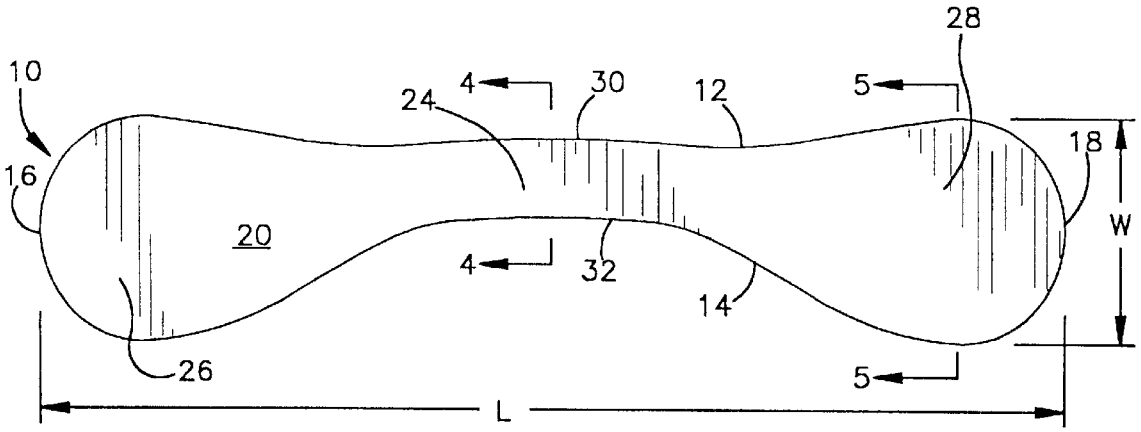
FIG. 2 is a front elevation view of the insert of FIG. 1.

As seen in FIG. 2, which depicts the preferred construction of the insert as a member secured to an already manufactured shoe, the insert 10 has a thickness designated by T, a width designated by W, and a length designated by L. In the preferred and illustrated embodiment, the insert is elongated with the length L being greater than the width W. This results in the insert contacting the back of a person's heel and extending around both sides of the heel; however, it will be recognized that the length of the insert may be varied so as to extend a desired distance around one or both sides of the heel.

The insert 10 includes an upper longitudinal edge 12 and a lower longitudinal edge 14 each of which extends along the length L of the insert. The longitudinal edges 12 and 14 are joined by a pair of lateral edges 16 and 18. The junctures of edges 12, 14 and edges 16, 18 are preferably in the form of rounded corners; however, the junctures could take any other desired shape. Additionally, the lateral edges 16 and 18 preferably, though not necessarily, have a curved or rounded configuration.

The insert 10 comprises an inner, heel-engaging surface 20 and an outer, shoe engaging surface 22. The insert 10 preferably is formed of a material that engages the heel with some degree of friction to reduce the tendency of the shoe to slide relative to the heel. The material from which the insert 10 is formed, in whole or in part, is preferably resilient to frictionally engage the heel yet provide a comfortable fit. The insert may be produced from various materials, for example, natural or synthetic foam or sponge rubber, natural or synthetic leather, etc. The material desirably is resilient or pliable enough so that the insert may be shaped to conform to the configuration of the interior of the shoe. Forming the insert of such material also reduces the likelihood that the insert will irritate a person's foot.

According to one aspect of the invention, which is included in the preferred embodiment illustrated in the Figures, the insert 10 has a reduced width central portion for engaging a person's foot at the area where the achilles tendon meets the heel bone. The insert 10 preferably has a pair of outermost portions that are wider than the reduced width central portion. More particularly, the insert 10 has a narrow central portion 24 that joins a pair of enlarged lateral portions 26 and 28. The narrow central portion 24 is defined by a central portion 30 of the upper longitudinal edge 12 and a central portion 32 of the lower longitudinal edge 14. The upper longitudinal edge 12 preferably flares slightly outward on each side of the central portion 30; however, the edge 12 may instead be substantially straight along the entire length L of the insert 10. The lower longitudinal edge 14 preferably flares outward away from the edge 12 on each side of the central portion 32, thereby providing the insert with a recess defining the narrow central portion 24 illustrated in the Figures. It will be appreciated by those skilled in the art that the insert may be shaped other than as illustrated, for example, by varying the relation between, or the lengths of, the longitudinal edges 12 and 14.

Figure 3:
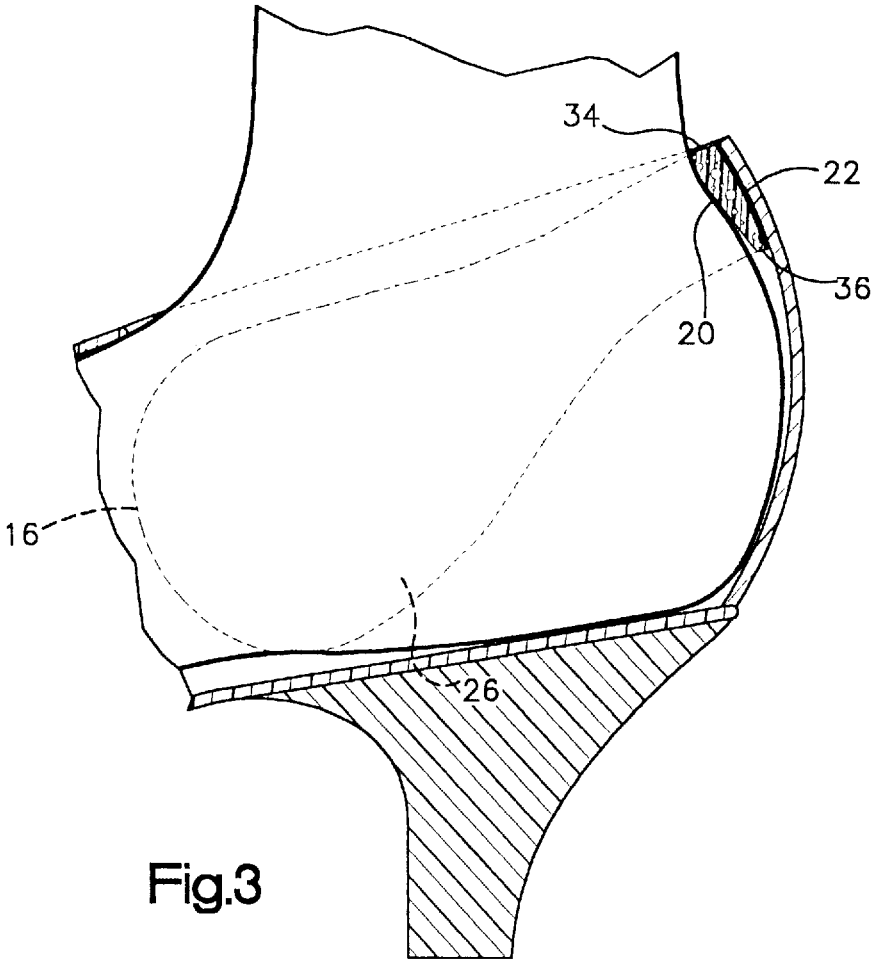
FIG. 3 is a sectional view of the insert of FIG. 1, taken along lines 3—3 in FIG. 1, showing part of a person's foot in the shoe.

The length of the narrow central portion 24 of the insert 10, which may be selected depending on various factors such as, for example, the size of the shoe with which the insert is to be used, preferably is sufficient to extend around the back of the heel and part of the sides of the heel (FIG. 3).

The width of the narrow central portion 24 is such that the portion fills the gap typically located between the heel of the shoe and the area of a person's foot at which the achilles tendon meets the heel bone (FIG. 3). The width of the central portion 24 is selected so that preferably all (or a majority) of the insert is located in the aforesaid gap. As a result, no portion (or only a minor portion) of the insert extends down into the area where the heel bone contacts the heel of the shoe, as seen, for example, in FIG. 3. This allows the heel to sit all the way back in the shoe while preventing (or reducing the possibility) of the insert wedging between the heel bone and the shoe and forcing the foot forward in the shoe.

The enlarged lateral portions 26 and 28 of the insert 10 preferably contact the sides of the heel bone so as to fill the gap present between the shoe and the sides of the heel bone.

In a preferred embodiment, the length of the narrow central portion 24 is in the range of from about one-third to about one-half the overall length of the insert 10 (FIG. 3).

The specific relationship between the maximum width of the narrow central portion 24 (i.e., between edge portions 30 and 32) and the maximum width of the lateral portions 26, 28 (i.e., between edges 12 and 14) of the insert 10 may be varied according to the invention. The maximum width of the central portion 24 preferably is less than about one-half the maximum width of one or both lateral portions 26 and 28. In the most preferred embodiment, the maximum width of the central portion 24 is about one-third the width of the lateral portions 26 and 28. Those skilled in the art will recognize that the exact ratio of the widths of the central and lateral portions of the insert may be altered from the preferred ratios for various applications.

Figure 4:
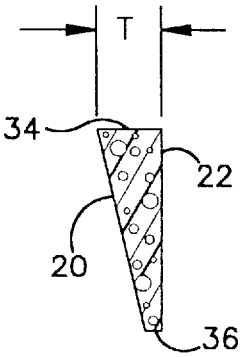
FIG. 4 is a sectional view of the insert of FIG. 1, taken along lines 4—4 in FIG. 2.

According to another aspect of the invention, which is included in the preferred embodiment illustrated in the Figures, the thickness T of the insert 10 is graduated so as to taper along the width W of the insert. As seen in FIG. 4, which is a sectional view through the narrow central portion 24 of the insert 10, the inner surface 20 is angled with respect to the outer surface 22 such that the thickness T decreases in a tapering manner from the upper longitudinal edge 12 toward the lower longitudinal edge 14. This results in the narrow central portion 24 having an upper exterior surface 34 that is larger than a corresponding lower exterior surface 36.

Figure 5:
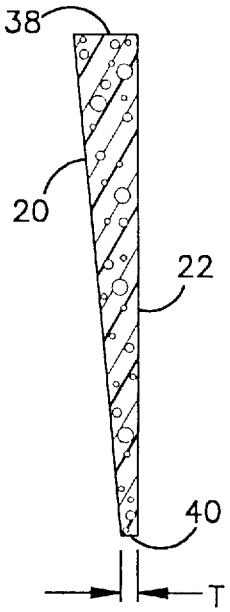
FIG. 5 is a sectional view of the insert of FIG. 1, taken along lines 5—5 in FIG. 2.

Similarly, as seen in FIG. 5, which is a sectional view through the enlarged lateral portion 28 of the insert 10, the inner surface 20 is angled with respect to the outer surface 22 such that the thickness T is tapered from the upper longitudinal edge 12 to the lower longitudinal edge 14. This results in the enlarged lateral portion 28 having an upper exterior surface 38 that is larger than a corresponding lower exterior surface 40. As can be seen in FIGS. 4 and 5, due to the narrow central portion 24 having a smaller width than the enlarged lateral portion 28, the angle of tapering in portion 24 is greater than in portion 28.

While the inner surface 20 of the insert 10 is angled and the outer surface 22 is straight (as viewed in FIGS. 4 and 5), both of these surfaces may be angled, for example, such that the outer surface 22 does not form a substantially right angle with the surfaces 34, 36, 38 40.

In the preferred and illustrated embodiment, the thickness T of the insert 10 is tapered along the entire length L thereof. It should be noted, however, that the thickness may be tapered over any desired portion of the length of the insert. Further, in the preferred embodiment the tapering is uniform over the length L of the insert 10. That is, the exterior surfaces 34 and 38 located respectively at the upper ends of the central portion 24 and the enlarged lateral portions 26 and 28 have the same thickness, as do the exterior surfaces 36 and 40 located respectively at the lower ends of the central portion 24 and the lateral portions 26 and 28. Those skilled in the art, of course, will recognize that the thickness T of the insert 10 may be non-uniform along the length L thereof if desired.

The extent or degree of tapering of the thickness T of the insert 10 may be selected according to the particular application of the invention. In a preferred embodiment, the thickness of the upper surfaces 34 and 38 is approximately one-eighth inch, while the thickness of the lower surfaces 36 and 40 is approximately, and preferably slightly less, than one-sixteenth inch. Of course, these dimensions are exemplary only. Also, while the preferred tapering is such that the lower edge of the insert is formed with flat surfaces 36, 40, the tapering may be more severe so as to lead to a feathered edge of very small thickness, for example, less than one-sixteenth of an inch.

Moreover, while the thickness T of the insert 10 is shown as tapering across the width W in a linear fashion, the tapering may be non-linear. For example, the thickness may decrease in a stepped, arcuate, or any other desired manner. In addition, rather than tapering the thickness T across the entire width W of the insert 10 as shown in FIGS. 4 and 5, the width of the insert may comprise a combination of both tapered and constant thickness portions.

As seen in FIG. 3, which shows a person's foot in a shoe that has been provided with an insert constructed according to the preferred embodiment of the invention, the insert occupies the gap that is typically located between the shoe and the area of the foot where the achilles tendon meets the heel bone. The insert acts somewhat as a wedge and serves to prevent the shoe from slipping off the heel, for example, during walking, while permitting the heel to sit fully back in the shoe. In addition, due to the tapered thickness of the insert, even if a portion of the insert is located between the heel bone and the shoe, the foot will not be pushed forward in the shoe an appreciable amount because the portion of the insert located against the heel bone has a reduced thickness.

Figure 6:
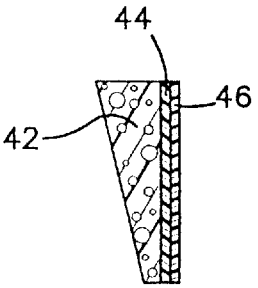
FIG. 6 is a sectional view of the insert of FIG. 1, wherein the insert includes a layer of adhesive and a release layer.

In the preferred and illustrated embodiment of the invention, the insert 10 is constructed as a device that is to be secured to an already manufactured shoe. That is, in order to adjust the fit of a pair of shoes a person secures the inserts in the interior heel areas of each shoe, thereby preventing the shoes from sliding or slipping relative to the person's heels. In order to facilitate attachment of an insert to the interior of a shoe, the insert preferably is provided with a layer of adhesive. Referring to FIG. 6, the insert (designated by reference numeral 42) has a layer of adhesive 44 on its shoe engaging surface, the adhesive being covered by a release layer 46 that is removed to expose the adhesive and secure the insert to a shoe. Any suitable adhesive may be utilized, e.g., a coating of pressure sensitive adhesive, a layer of double-sided adhesive tape, etc. As noted above, however, the invention also may be practiced by securing an insert to or within a shoe during manufacturing of the shoe, thereby permitting a person to obtain a correct size shoe that also stays on their feet.

The shoe insert of the present invention provides a device that overcomes problems in the art by comfortably engaging a person's foot to prevent a shoe from sliding relative to the foot, which not only helps to keep the shoe on, but also reduces the likelihood of irritation to the feet.

While in the preferred embodiment the insert has a narrow central portion between two enlarged lateral portions, and also has a tapered thickness, it should be recognized that according to the teachings of the invention the insert may have a narrow central portion as shown but a non-tapered thickness, or a tapered thickness as shown but a substantially constant width across its length (i.e., no narrow central portion).

Although the invention has been described in its preferred form with a certain degree of particularity, it will be understood that the present detailed disclosure is made only by way of example and that numerous changes in the details of construction, operation and the combination and arrangement of parts may be made without departing from the spirit or scope of the invention as hereinafter claimed.

What is claimed is:

1. A device for use with a shoe, the device comprising:

an insert formed at least in part of generally resilient material, the insert having a thickness, width and length, the width defined between upper and lower edges, wherein the length is greater than the width such that the insert has a generally elongated shape;

wherein the insert includes a central portion having a narrow width relative to opposite lateral portions having an enlarged width;

wherein the insert has a thick area located adjacent the upper edge of the insert and a thin area located adjacent the lower edge of the insert, and the thickness of the insert is tapered from said thick area to said thin area the angle of tapering in said central portion being greater than the angle of tapering in said opposite lateral portions.

2. A device according to claim 1, wherein the thickness of the insert is linearly tapered.

3. A device according to claim 1, wherein the width of the insert at the narrow central portion is less than about one-half the width of the insert at the enlarged lateral portions.

4. A device according to claim 3, wherein the width of the insert at the narrow central portion is about one-third the width of the insert at the enlarged lateral portions.

5. A device according to claim 1, wherein the insert includes a first surface provided with means for attaching the insert to an interior portion of a shoe, and a second surface comprising the resilient material for contacting a wearer's foot.

6. A device according to claim 1, wherein the insert has a laminated structure comprising a first layer of resilient material, a layer of adhesive disposed on one surface of the resilient material, and a release layer disposed on the adhesive layer.

7. A device according to claim 1, wherein the resilient material comprises a rubber material.

8. A device according to claim 1, in combination with a shoe including a heel-receiving portion, wherein the insert is located on the heel-receiving portion of said shoe.

9. A device for use with a shoe, the device comprising:

an insert formed of a material that is at least partially resilient, the insert having a first surface for attachment to an interior portion of a shoe and a second surface for contacting a wearer's foot;

wherein the insert includes upper and lower longitudinal edges extending in a first general direction, and a pair of lateral edges extending between the upper and lower longitudinal edges, the upper and lower longitudinal edges being longer than the lateral edges;

wherein the insert has a narrow central portion for contacting the heel of a wearer's foot and two enlarged lateral portions disposed on opposite sides of the central portion for contacting the sides of a wearer's foot;

wherein each of the central portion and the lateral portions of the insert has a maximum width defined between the upper and lower longitudinal edges, and the maximum width of the central portion is less than about one-half the maximum width of at least one of the lateral portions; and wherein the central portion and the lateral portions of the insert have respective thicknesses that are tapered in a direction extending from the upper longitudinal edge to the lower longitudinal edge, the angle of tapering in said central portion thickness being greater than the angle of tapering in said lateral portions thickness.

10. A device according to claim 9, wherein the maximum width of the central portion is about one-third the maximum width of at least one of the lateral portions.

11. A device according to claim 9, wherein the upper longitudinal edge is substantially straight and the lower longitudinal edge has a central recess, and the lateral edges are rounded and connect the upper and lower longitudinal edges.

12. A device according to claim 9, wherein the insert comprises a rubber substrate with a surface carrying means for securing the insert to a shoe.

13. A device according to claim 9, in combination with a shoe including a heel-receiving portion, wherein the insert is located on the heel-receiving portion of said shoe.

14. A process for adjusting the fit of a shoe on a wearer's foot, the process comprising steps of:

providing an insert that may be configured to conform to an interior surface of a heel-receiving portion of a shoe, the insert comprising a central portion adapted to contact the back of a wearer's foot and a pair of side portions adapted to contact part of the sides of a wearer's foot, the central portion and side portions of the insert having respective thicknesses that taper from a thick edge toward a thin edge, the angle of tapering in the central portion thickness being greater than the angle of tapering in the side portions thickness;

securing the insert to an interior surface of a heel-receiving portion of a shoe with the central portion of the insert located to contact a wearer's foot between the heel bone and the achilles tendon, and the side portions located to contact the sides of the heel bone of a wearer's foot, wherein the thick edge of the central portion of the insert is located adjacent a top of the heel-receiving portion of the shoe so that the thickness of the central portion of the insert decreases toward a bottom of the heel-receiving portion of the shoe.

15. A process according to claim 14, wherein the pair of side portions of the insert are tapered in thickness to correspond to the tapered thickness of the central portion of the insert.

16. A process according to claim 14, wherein the step of securing the insert comprises removing a release layer from an exterior surface of the insert to expose an adhesive layer, and pressing the adhesive layer against the interior surface of the heel-receiving portion of the shoe.

17. A process according to claim 14, wherein the step of securing the insert comprises securing the insert to the heel-receiving portion of the shoe while manufacturing the shoe.

* * * * *